US010682686B2

(12) United States Patent
Yang et al.

(10) Patent No.: US 10,682,686 B2
(45) Date of Patent: Jun. 16, 2020

(54) ECO-MOLD APPARATUS FOR MANUFACTURING PISTON, MOLD APPARATUS FOR MANUFACTURING PISTON, AND PISTON MANUFACTURING METHOD

(71) Applicant: DONG YANG PISTON CO., LTD., Gyeonggi-do (KR)

(72) Inventors: Jun Kui Yang, Seoul (KR); Kwan Ho Ryu, Gyeonggi-do (KR); Jeong Keon Lee, Incheon (KR); Lee Cheol Ji, Gyeonggi-do (KR); Sang Min Lee, Gyeonggi-do (KR)

(73) Assignee: DONG YANG PISTON CO., LTD, Gyeonggi-Do (KR)

( * ) Notice: Subject to any disclaimer, the term of this patent is extended or adjusted under 35 U.S.C. 154(b) by 305 days.

(21) Appl. No.: 15/743,785

(22) PCT Filed: Feb. 26, 2016

(86) PCT No.: PCT/KR2016/001899
§ 371 (c)(1),
(2) Date: Jan. 11, 2018

(87) PCT Pub. No.: WO2017/086544
PCT Pub. Date: May 26, 2017

(65) Prior Publication Data

US 2018/0207715 A1 Jul. 26, 2018

(30) Foreign Application Priority Data

Nov. 17, 2015 (KR) ..... 10-2015-0161250

(51) Int. Cl.
*B22C 9/06* (2006.01)
*B22D 15/02* (2006.01)
(Continued)

(52) U.S. Cl.
CPC ..... *B22C 9/06* (2013.01); *B22C 9/101* (2013.01); *B22C 9/108* (2013.01); *B22C 9/22* (2013.01);
(Continued)

(58) Field of Classification Search
CPC ..... B22C 9/06; B22C 9/101; B22C 9/108; B22C 9/22; B22D 15/02; B22D 17/2236; B22D 25/02; B22D 29/001; B22D 33/04
See application file for complete search history.

(56) References Cited

U.S. PATENT DOCUMENTS 5,758,710 A * 6/1998 Landua ..... B22C 9/103 164/200
2010/0101689 A1* 4/2010 Wust ..... B22D 31/002 148/549
2016/0236272 A1* 8/2016 Yoneda ..... B22D 25/02

FOREIGN PATENT DOCUMENTS

JP 06-192703 7/1994
JP 2007-198228 8/2007
(Continued)

*Primary Examiner* — Kevin P Kerns
*Assistant Examiner* — Steven S Ha
(74) *Attorney, Agent, or Firm* — Stuart H. Mayer; Mayer & Williams PC

(57) ABSTRACT

The present invention relates to an eco-mold apparatus for manufacturing a piston, a mold apparatus for manufacturing a piston, and a piston manufacturing method, which mold each part of a piston while decreasing the weight of the piston, and the apparatus may comprise: a first eco-mold part which may move forward or backward in a first direction to shape a portion of an eco-part of a piston; a second eco-mold part which may shape-match with the first eco-mold part to mold another portion of the eco-part of the piston; and a piston pickup part which picks up the piston over the second eco-mold part, so that the piston pickup part can separate the piston from the second eco-mold part.

12 Claims, 5 Drawing Sheets

(51) Int. Cl.

| | |
|---|---|
| ***B22C 9/10*** | (2006.01) |
| ***B22C 9/22*** | (2006.01) |
| ***B22D 17/22*** | (2006.01) |
| ***F02F 3/00*** | (2006.01) |

(52) U.S. Cl.
CPC ..... *B22D 15/02* (2013.01); *B22D 17/2236* (2013.01); *F02F 3/00* (2013.01); *F02F 2003/0007* (2013.01)

(56) References Cited

FOREIGN PATENT DOCUMENTS

| | | | | |
|---|---|---|---|---|
| KR | 1020090127955 | | | 12/2009 |
| KR | 1020110096740 | | | 8/2011 |
| KR | 20150078072 | A | * | 7/2015 |
| KR | 1020150078072 | | | 7/2015 |
| WO | WO-2015045121 | A1 | * | 4/2015 |

* cited by examiner

ECO-MOLD APPARATUS FOR MANUFACTURING PISTON, MOLD APPARATUS FOR MANUFACTURING PISTON, AND PISTON MANUFACTURING METHOD

TECHNICAL FIELD

The present invention relates to an eco-mold apparatus for manufacturing a piston, a mold apparatus for manufacturing a piston, and a piston manufacturing method, and more particularly to an eco-mold apparatus for manufacturing a piston, a mold apparatus for manufacturing a piston, and a piston manufacturing method, which is to form each part of a piston while reducing the weight of the piston.

BACKGROUND ART

Generally, cars produce driving power by burning gasoline or diesel and liquified natural gas or the like and using the explosive power therefrom to rotate a crank shaft, and have an internal combustion engine (hereinafter referred to as an "engine") provided with a cylinder for compressing a mixture gas of fuel and air and burning the mixture gas. The engine is provided with a cylinder block which forms a plurality of cylinders, a cylinder head which is provided at a lower portion of the cylinder block and provides a combustion chamber, and a piston for an internal combustion engine which is configured such that the piston is installed within the cylinder to reciprocatively move up and down in the cylinder while carrying out the function of receiving a gas pressure in a high temperature and pressure generated in the process of expansion resulting from the explosion of the mixture gas and transferring it through a connecting road to the crank shaft. This piston for an internal combustion engine comprises a crown part, a boss part and a box part, and is made by using a piston mold apparatus.

Meanwhile, weight of the piston which reciprocatively moves in the cylinder of the engine acts as inertial force to have a significant influence on the designed strength and endurance of each constituent components of the engine. Thus, efforts for reducing the weight relative to the boss and box parts of the piston are continuing focusing on parts which scarcely have a large effect on the designed strength and endurance.

DETAILED DESCRIPTION OF THE INVENTION

Technical Problem

However, the piston mold apparatus mentioned above had such a problem that since assembling and dissembling of the mold apparatus was made in a straight line because of the characteristic of the mold apparatus, combinations of mold parts which are divided in complexly structured pieces were required in order to perform casting of the boss and box parts of the piston having an oblique shape and cast a coring shape of the boss part of the piston, whereby manufacturing cost of the mold was increased and the processing time for casting the piston was extended, so that work productivity was deteriorated.

In addition, due to the problem mentioned above, it was difficult to form an eco-part, which is a deep groove of an undercut shape, at a connection region between the box and boss parts of the piston, so that there was a limitation in reducing weight of the piston.

The present invention is to solve various problems including the aforementioned problems and aims to provide an eco-mold apparatus for manufacturing a piston, a mold apparatus for manufacturing a piston, and a piston manufacturing method, which can easily cast an obliquely formed box part of a piston and easily form an eco-part, which is a deep groove of an undercut shape, at a connection portion between box and boss parts of a piston. However, it should be appreciated that the objects mentioned above are illustrated only for exemplification and the scope of the present invention itself is not limited by these objects.

Technical Solution

According to an aspect of the present invention, there may be provided an eco-mold apparatus for manufacturing a piston. The eco-mold apparatus for manufacturing a piston may comprise: a first eco-mold part which can move forward or backward in a first direction to mold a portion of an eco-part of the piston; a second eco-mold part which can be engaged with the first eco-mold part to mold another portion of the eco-part of the piston; and a piston pickup part which picks up the piston over the second eco-mold part to separate the piston from the second eco-mold part.

In the eco-mold apparatus for a piston described above, the piston pickup part may comprise a clamping member which presses a portion of a side surface of a crown part of the piston and picks up the piston over the second eco-mold part.

In the eco-mold apparatus for a piston described above, the first eco-mold part may comprise: a first engaging surface which has a first engaging angle relative to a central axis of the piston to be engaged with the second eco-mold part at an engaging portion engaged with the second eco-mold part; and a box part molding surface which is formed at a portion corresponding to an outer side of a box part and has a second inclination angle relative to the central axis of the piston to be engaged with the second eco-mold part, and the second eco-mold part may comprise a second engaging surface which has the first engaging angle at a portion corresponding to the first engaging surface to be engaged with the first eco-mold part.

In the eco-mold apparatus for a piston described above, the first engaging angle may be formed 6° to 10° larger than the second inclination angle of the box part molding surface relative to the central axis of the piston, and the first direction may be a direction inclined from the central axis of the piston by a third moving angle which may be 3° to 5° larger than the second inclination angle relative to the central axis of the piston.

In the eco-mold apparatus for a piston described above, the piston pickup part may be formed in a shape corresponding to a picked-up portion of the piston, and after the first eco-mold part is retreated in the first direction, the piston pickup part may pick up the piston over the second eco-mold part to separate the piston from the second eco-mold part In the eco-mold apparatus for a piston described above, the first eco-mold part and the second eco-mold part may be symmetrically formed on both sides relative to the axis of the piston.

In the eco-mold apparatus for a piston described above, the piston pickup part may further comprise a vacuum suction member which holds an upper surface of a crown part of the piston with vacuum suction to pick up the piston over the second eco-mold part.

In the eco-mold apparatus for a piston described above, the piston pickup part further comprises a magnetic member which contacts with an upper surface of the piston and picks up the piston over the second eco-mold part with magnetic force.

According to an aspect of the present invention, there may be provided a mold apparatus for manufacturing a piston. The mold apparatus for manufacturing a piston comprises: an upper mold which moves up and down to form an upper portion of a crown part of the piston; a left mold which slidably moves to form one side of a side portion of the crown part of the piston; a right mold which slidably moves to form the other side of the side portion of the crown part of the piston; a lower mold which moves up and down to form an inner surface of a box part of the piston; a pin mold which moves left or right to form a pin hole of the piston; and the eco-mold apparatus for manufacturing a piston according to any one of Claims 1 to 8.

According to an aspect of the present invention, there may be provided a piston manufacturing method. The piston manufacturing method comprises: a mold closing step for closing a mold including a first eco-mold part and a second eco-mold part to form a mold cavity for casting a piston; a casting step for injecting a predetermined amount of a melted fluid piston material into the mold cavity to cast the piston; a cooling step for cooling the melted fluid piston material; a first eco-mold part retreating step for moving back the first eco-mold part in a first direction to separate the first eco-mold part from the second eco-mold part; and a pickup step in which the piston pickup part upwardly picks up the piston to separate the piston from the second eco-mold part.

Advantageous Effects

According to an embodiment of the present invention configured as described above, the inclinedly formed box part of the piston can be easily casted and the eco-part which is a deep groove of an undercut shape formed at the connection region between the box and crown parts of the piston can be easily molded.

In addition, the eco-part of the piston can be easily molded to efficiently reduce weight of the piston. Thus, it is possible to embody an eco-mold apparatus for manufacturing a piston, a mold apparatus for manufacturing a piston, and a piston manufacturing method, which can make a piston that has such effects that it is possible to increase endurance of the engine by reducing inertial force each constituent components of the engine receives from the piston and increase fuel efficiency of vehicles due to the reduction in weight of the piston. However, it should be appreciated that the scope of the present invention is not limited by these effects.

MODE OF THE INVENTION

Figure 1:
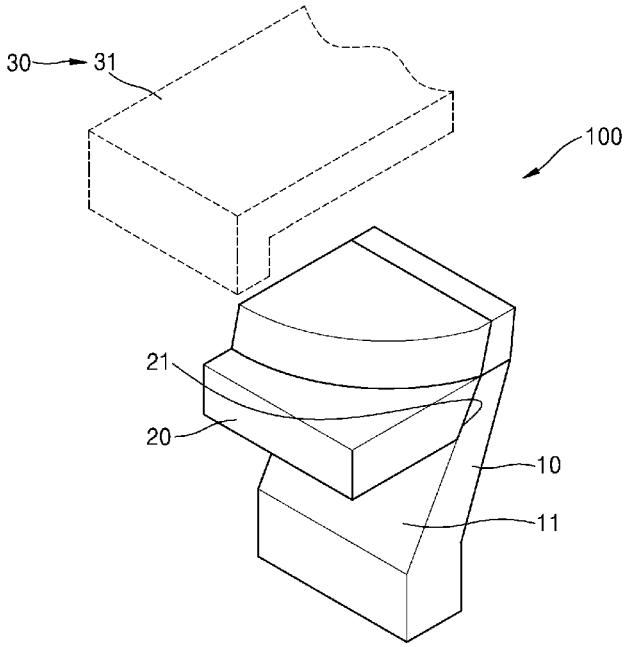
FIG. 1 is a perspective view showing an eco-mold apparatus 100 for manufacturing a piston according to an embodiment of the present invention.

Hereinafter, various embodiments of the present invention will be described in detail with reference to the accompanying drawings.

Although the following embodiments of the present invention are proposed to more completely illustrate the present invention, such embodiments can be modified in various different forms and the scope of the present invention is not limited to such embodiments. These embodiments are rather provided to make the present disclosure more sufficient and complete and to more completely deliver the idea of the present invention to a person skilled in the art. In addition, thickness or size of each layer may be exaggerated in the drawings for the purpose of easy and clear explanation.

Figure 2:
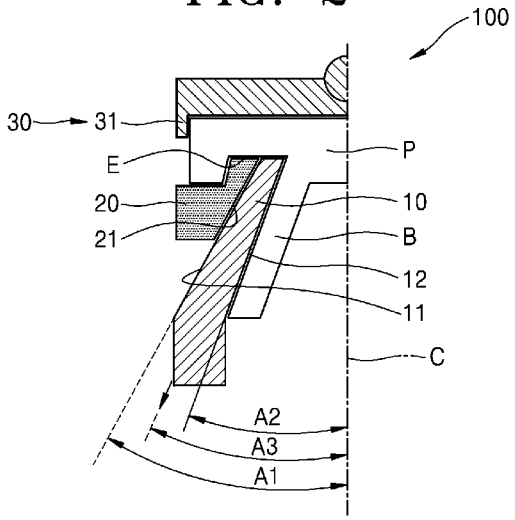
FIG. 2 is a cross-sectional view showing the eco-mold apparatus 100 for manufacturing a piston of FIG. 1.

FIG. 1 is a perspective view showing an eco-mold apparatus 100 for manufacturing a piston according to an embodiment of the present invention, and FIG. 2 is a cross-sectional view showing the eco-mold apparatus 100 for manufacturing a piston of FIG. 1.

First, as shown in FIG. 1, the eco-mold apparatus 100 for manufacturing a piston according to an embodiment of the present invention may include a first eco-mold part 10, a second eco-mold part 20, and a piston pickup part 30.

For example, as shown in FIG. 2, the first eco-mold part 10 may move forward and backward in a first direction such that a portion of an eco-part E of a piston P is molded. For example, in the first eco-mold part 10, a first engaging surface 11 may be formed to be able to engage with the second eco-mold part 20 such that the first engaging surface 11 has a first engaging angle A1 relative to a central axis C of the piston P at an engaging portion to engage with the second eco-mold part 20 in the mold, and a box part molding surface 12 may be formed to mold an outer side of the inclined box part B of the piston such that the box part molding surface 12 is formed at a portion corresponding to the outer side of the box part B and has a second inclination angle A2 relative to the central axis C of the piston P.

Herein, the first engaging angle A1 of the first engaging surface 11 may be formed 6° to 10° larger than the second inclination angle A2 of the box part molding surface 12 relative to the central axis C of the piston P. In addition, the first direction of the first eco-mold part 10 may be a direction inclined from the central axis C of the piston P by a third moving angle A3, which is 3° to 5° larger than the second inclination angle A2 relative to the central axis C of the piston P.

For example, the first engaging angle A1 of the first engaging surface 11 may be formed to be 31°, the second inclination angle A2 to be 21°, and the third moving angle A3 to be 26°. Due to the difference of angle between the first engaging angle and the second inclination angle A2 and the third moving angle A3 as described above, when the first eco-mold part 10 moves back in the first direction, a gap may be formed between the first engaging surface 12 and the engaging portion which engages with the second eco-mold part 20, and between the box part molding surface 12 and the box part B of the piston P.

Accordingly, as shown in FIG. 2, when the first eco-mold part 10 moves back in the first direction, the first eco-mold part 10 moves with a gap being formed at each of the engaging portion and the box part B adjacent to the first eco-mold part 10, whereby no friction between the engaging portion and the box part B occur and thus the first eco-mold part 10 can smoothly move back.

Moreover, since the first eco-mold part 10 can obliquely move forward or backward between the box part B and a crown part of the piston P, it is possible to easily form an eco-part E, which is a deep groove of an undercut shape formed at a connection portion between the box part B and the crown part of the piston P, when casting the piston P.

Therefore, as shown in FIG. 2, friction can be prevented from occurring at the engaging portion and the box part B when the first eco-mold part 10 moves back, whereby it is possible to extend life span of the eco-mold parts 10, 20 and increase quality of the casted piston P.

Furthermore, since the eco-part E can be easily molded to efficiently reduce weight of the piston P, it is possible to increase endurance of the engine by reducing inertial force each constituent component of the engine receives from the piston P. Particularly, reducing weight of the piston P causes reduction in weight of driving components of the engine itself, which can result in an even more significant weight reduction effect compared to reducing weight of the chassis.

Furthermore, as shown in FIG. 2, the second eco-mold part 20 may engage with the first eco-mold part 10 to mold another portion of the eco-part E of the piston P. For example, in the second eco-mold part 20, a second engaging surface 21 may be formed to be able to engage with the first eco-mold part 10 such that the second engaging surface 21 has the first engaging angle A1 at a portion corresponding to the first engaging surface 11.

Accordingly, as shown in FIG. 2, the eco-part E, which is a deep groove of an undercut shape formed at a connection region between the box part B and the crown part of the piston P, can be easily molded by engaging the second eco-mold part 20 with the first eco-mold part 10 when casting the piston P.

Therefore, since the eco-part E can be easily molded due to the engagement of the first eco-mold part 10 and the second eco-mold part 20, weight of the piston P can be efficiently reduced, so that it is possible to increase endurance of the engine by reducing inertial force each constituent component of the engine receives from the piston P.

In addition, as shown in FIG. 2, the piston pickup part 30 may pick up the piston P over the second eco-mold part 20 to be able to separate the piston P from the second eco-mold part 20. For example, the piston pickup part 30 may include a clamping member 31 which presses and holds a portion of a side surface of the crown part of the piston P to pick up the piston P over the second eco-mold part 20.

For example, the piston pickup part 30 may be formed in a shape corresponding to a picked-up portion of the piston P, and pick up the piston P over the second eco-mold part 20 after the first eco-mold part 10 is retreated in the first direction, whereby the piston P can be separated from the second eco-mold part 20. In this case, the clamping member 31 of the piston pickup part 30 may be formed in a shape corresponding to the picked-up portion of the piston P.

Moreover, a side surface of the eco-part E which contacts with the second eco-mold part 20 may be formed in a gradient shape where an upper portion of the side surface is inclined toward the central axis C of the piston P. Thus, when the piston pickup part 30 lifts up the piston P over the second eco-mold part 20, the side surface of the eco-part E can be guided to be smoothly separated without being scratched by the second eco-mold part 20.

Accordingly, as shown in FIG. 2, when the piston P is molded, the piston pickup part 30 can be operated such that after the first eco-mold part 10 is withdrawn in the first direction, the clamping member 31 formed in a shape corresponding to the picked-up portion of the piston P picks up the piston P over the second eco-mold part 20. Thus, the eco-part E of the piston P can be smoothly separated without being caught by the second eco-mold part 20 after the piston P has been molded.

Therefore, as shown in FIG. 2, since the piston pickup part 30 can smoothly separate the piston P, in which the undercut-shaped eco-part E is formed, from the second eco-mold part 20, the eco-part E can be easily formed to reduce weight of the piston P efficiently. Thus, it is possible to increase endurance of the engine by reducing inertial force each constituent component of the engine receives from the piston P.

Figure 3:
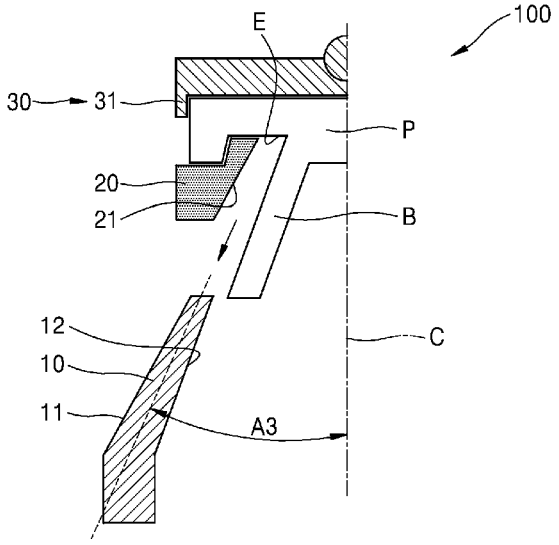
FIGS. 3 to 5 are cross-sectional views showing an operating sequence for the eco-mold apparatus for manufacturing a piston of FIG. 1.
Figure 4:
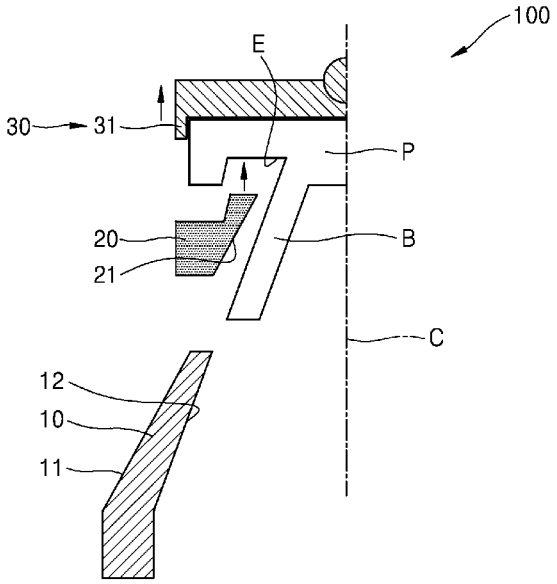
Figure 5:
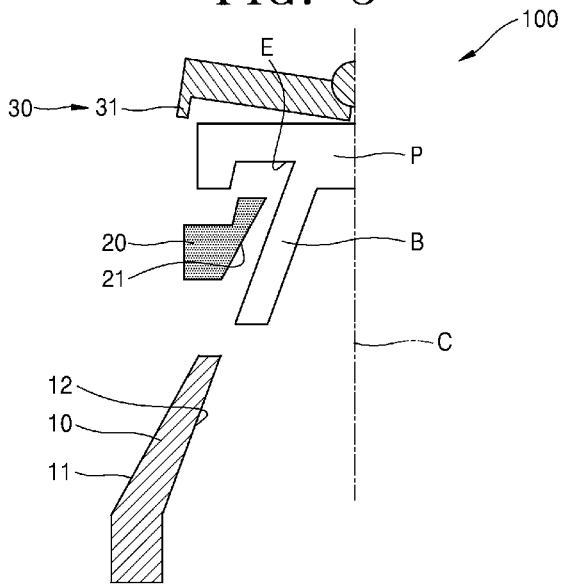

FIGS. 3 to 5 are cross-sectional views showing an operating sequence for the eco-mold apparatus for manufacturing a piston of FIG. 1.

For example, as shown in FIG. 3, the first eco-mold part 10 may move back in the first direction after completion of the casting of the piston P. At this point, a gap space D may be formed between the first engaging surface 11 and the second engaging surface 21 due to the difference in angle between the first engaging angle A1 of the first engaging surface 11 and the third moving angle A3 of the first direction.

Further, although it is not shown in the drawings, a separate cylinder device may be added to the mold M and the first eco-mold part 10 may be moved forward or backward by the cylinder device. In this case, the cylinder device may employ hydraulic cylinders or actuators. However, the cylinder device is not limited to these devices and a wide variety of devices which can move the first eco-mold part 10 forward or backward may be adopted.

Furthermore, besides the cylinder devices described above, the first eco-mold part 10 may be operatively linked to an upper mold M1 or a lower mold M2 with a separate guide bar (not shown) to move forward or backward along with an up-and-down motion of the upper mold M1 or the lower mold M2.

Subsequently, as shown in FIG. 4, the piston pickup part 30 may pick up the piston P over the second eco-mold part 20 after the first eco-mold part 10 has retreated in the first direction. For example, the clamping member 31 formed in the piston pickup part 30 may press and hold a portion of the side surface of the crown part of the piston P and lift up the piston P over the second eco-mold part 20. Thus, the eco-part E of the piston P can be separated from the second eco-mold part 20.

Subsequently, as shown in FIG. 5, after the piston pickup part 30 has picked up the piston P over the second eco-mold part 20, the clamping member 31 may become wider relative to the axis C of the piston P to separate the picked-up piston P from the piston pickup part 30. For example, a hinge may be formed at an intermediate portion of the piston pickup part 30 and a pair of clamping members 31 which are symmetrically formed on both sides of the hinge may rotate away from each other about the hinge and become wider to separate the piston P from the piston pickup part 30.

In addition, although it is not shown in the drawings, a separate cylinder device may be added to the upper mold M1 and the piston pickup part 30 may be moved up and down by the cylinder device. In this case, the cylinder device may employ hydraulic cylinders or actuators. However, the cylinder device is not limited to these devices and a wide variety of devices which can move the piston pickup part 30 up and down may be adopted.

Accordingly, as shown in FIGS. 3 to 5, in the eco-mold apparatus 100 for manufacturing a piston according to an embodiment of the present invention, when the piston P is casted, the eco-part E of an undercut shape can be formed in the piston P by using the first eco-mold part 10 and the second eco-mold part 20, and when the casting of the piston P is completed, the eco-part E of an undercut shape can be smoothly separated from the second eco-mold part 20.

Therefore, as shown in FIGS. 3 to 5, in the eco-mold apparatus 100 for manufacturing a piston, since the first eco-mold part 10 can be smoothly separated from the undercut-shaped eco-part E and the undercut-shaped eco-part E can be smoothly separated from the second eco-mold part 20 by the piston pickup part 30, the eco-part E can be easily molded to efficiently reduce weight of the piston P. Thus, it is possible to increase endurance of the engine by reducing inertial force each constituent component of the engine receives from the piston P.

Figure 6:
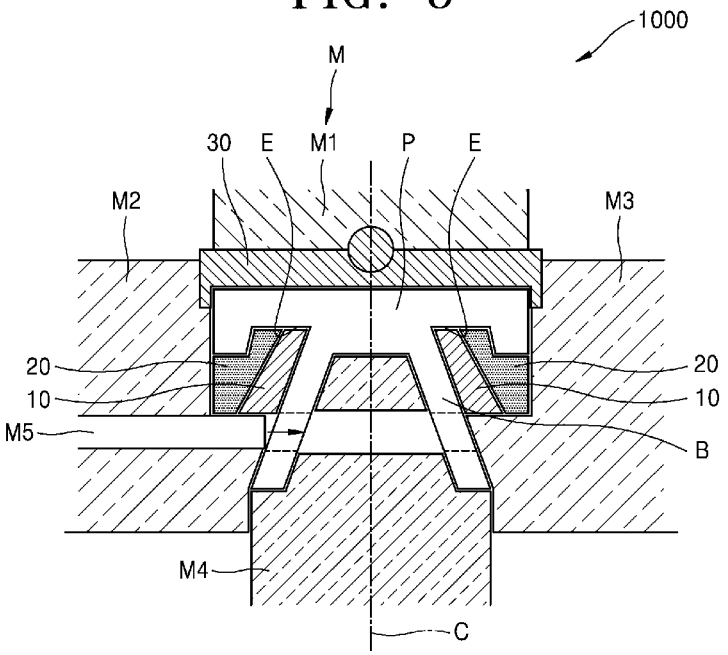
FIG. 6 is a cross-sectional view showing a mold apparatus 1000 for manufacturing a piston according to an embodiment of the present invention.
Figure 7:
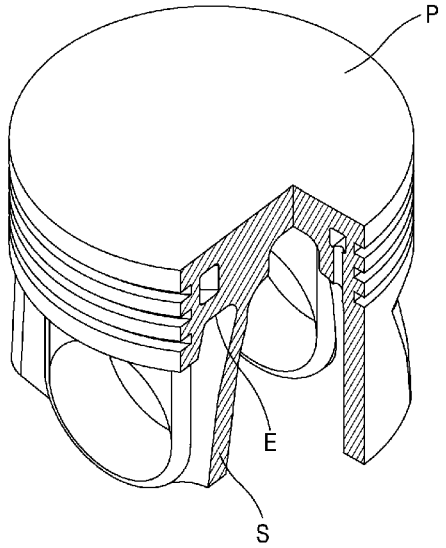
FIG. 7 is a partially cross-sectioned perspective view showing a piston P made by the mold apparatus 100 for manufacturing a piston of FIG. 6.

FIG. 6 is a cross-sectional view showing a mold apparatus 1000 for manufacturing a piston according to an embodiment of the present invention, and FIG. 7 is a partially cross-sectioned perspective view showing a piston P made by the mold apparatus 100 for manufacturing a piston of FIG. 6.

For example, as shown in FIG. 6, the mold apparatus 1000 for manufacturing a piston may include: an upper mold M1 which moves up and down to form an upper portion of the crown part of the piston P; a left mold M2 which slidably moves to form one side of a side portion of the crown part of the piston P; a right mold M3 which slidably moves to form the other side of the side portion of the crown part of the piston P; a lower mold M4 which moves up and down to form an inner surface of the box part B of piston P; and a pin mold M5 which moves left or right to form a pin hole of the piston P, and may include an eco-mold apparatus 100 for manufacturing a piston which is provided with the first eco-mold part 10, the second eco-mold part 20 and the piston pickup part 30.

For example, the first eco-mold part 10 and the second eco-mold part 20 of the eco-mold apparatus 100 for manufacturing a piston may be formed symmetrically on opposite sides of the central axis C of the piston P to mold the eco-part E along a periphery of the piston P.

Accordingly, as shown in FIG. 7, when the piston P is casted, the eco-part E of an undercut shape can be formed in the piston P by using the mold apparatus 1000 for manufacturing a piston. Therefore, the undercut-shaped eco-part E can be easily formed to reduce weight of the piston P efficiently. Thus, it is possible to increase endurance of the engine by reducing inertial force each constituent component of the engine receives from the piston P, so that the fuel efficiency of a vehicle can be increased due to the reduction in weight of the piston P.

Figure 8:
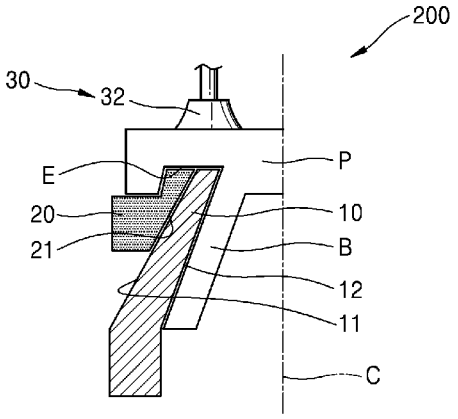
FIG. 8 is a cross-sectional view showing an eco-mold apparatus 200 for manufacturing a piston according to another embodiment of the present invention.

FIG. 8 is a cross-sectional view showing an eco-mold apparatus 200 for manufacturing a piston according to another embodiment of the present invention.

For example, as shown in FIG. 8, the piston pickup part 30 may further include a vacuum suction member 32 which holds an upper surface of the crown part of the piston P with vacuum suction to pick up the piston P over the second eco-mold part 20. For example, the vacuum suction member 32 may be communicated with a vacuum motor which generates a vacuum force, and after contacting with the upper surface of the crown part of the piston P, the vacuum suction member 32 may absorb and pick up the upper surface of the crown part of the piston P by means of the vacuum generated by the vacuum motor.

Accordingly, as shown in FIG. 8, since the piston pickup part 30 of the eco-mold apparatus 200 for manufacturing a piston according to another embodiment of the present invention picks up the piston P with vacuum suction using the vacuum suction member 32, damages such as a dent or scratch to the piston P resulting from a pickup by physical force can be prevented from occurring when the piston P is picked up.

Figure 9:
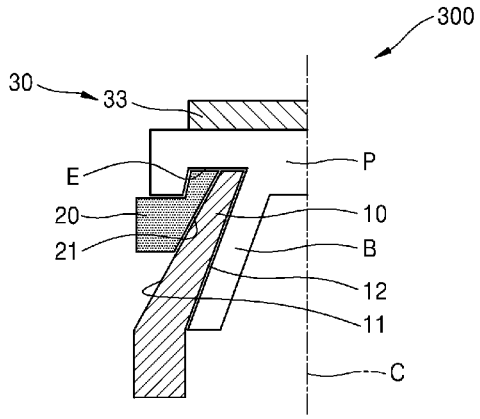
FIG. 9 is a cross-sectional view showing an eco-mold apparatus 300 for manufacturing a piston according to yet another embodiment of the present invention.

FIG. 9 is a cross-sectional view showing an eco-mold apparatus 300 for manufacturing a piston according to yet another embodiment of the present invention.

For example, as shown in FIG. 9, the piston pickup part 30 may further include a magnetic member 33 which contacts with the upper surface of the crown part of the piston P and lifts the piston p upward over the second eco-mold part 20 with magnetic force. Foe example, the magnetic member 33 may be employed to a piston P which is casted of a ferromagnetic body such as steel and can contact the upper surface of the crown part of the piston P to pick up the piston P with magnetic force.

Accordingly, as shown in FIG. 9, since the piston pickup part 30 of the eco-mold apparatus 300 for manufacturing a piston according to yet another embodiment of the present invention picks up the piston P with magnetic force using the magnetic member 33, damages such as a dent or scratch to the piston P resulting from a pickup by physical force can be prevented from occurring when the piston P is picked up.

Figure 10:
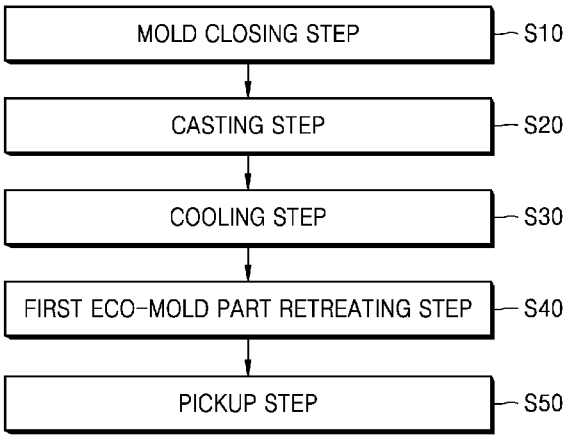
FIG. 10 is a flow chart showing a piston manufacturing method according to an embodiment of the present invention.

FIG. 10 is a flow chart showing a piston manufacturing method according to an embodiment of the present invention.

For example, as shown in FIG. 10, the piston manufacturing method according to an embodiment of the present invention may include: a mold closing step (S10) for closing a mold M including the first eco-mold part 10 and the second eco-mold part 20 to form a mold cavity for casting the piston P; a casting step (S20) for injecting a predetermined amount of a melted fluid piston material into the mold cavity to cast the piston P; a cooling step (S30) for cooling the melted fluid piston material; a first eco-mold part retreating step (S40) for moving back the first eco-mold part 10 in the first direction to separate the first eco-mold part 10 from the second eco-mold part 20; and a pickup step (S50) in which the piston pickup part 30 upwardly picks up the piston P to separate the piston P from the second eco-mold part 20;

Accordingly, as shown in FIG. 10, in the piston manufacturing method according to an embodiment of the present invention, the inclinedly formed box part B of the piston P can be easily casted and the undercut-shaped eco-part E which is formed at the connection region between the box part B and the crown part of the piston P can be easily molded.

Therefore, the eco-part E of the piston P can be easily formed to reduce weight of the piston P efficiently. Thus, it is possible to increase endurance of the engine by reducing inertial force each constituent component of the engine receives from the piston P, so that the fuel efficiency of a vehicle can be increased due to the reduction in weight of the piston P.

While the present invention has been illustrated herein with reference to the embodiments shown in the drawings, it will be understood that such embodiments are merely examples and a person skilled in the art could derive various modifications and other equivalent embodiments therefrom. Therefore, the actual technical scope of the present invention should be constructed based on the technical spirit of the appended claims.

INDUSTRIAL APPLICABILITY

According to an embodiment of the present invention configured as described above, the inclinedly formed box part of the piston can be easily casted and the eco-part which is a deep groove of an undercut shape formed at the connection region between the box and crown parts of the piston can be easily molded.

In addition, the eco-part of the piston can be easily molded to efficiently reduce weight of the piston. Thus, it is possible to embody an eco-mold apparatus for manufacturing a piston, a mold apparatus for manufacturing a piston, and a piston manufacturing method, which can make a piston that has such effects that it is possible to increase endurance of the engine by reducing inertial force each constituent components of the engine receives from the piston and increase fuel efficiency of vehicles due to the reduction in weight of the piston.

What is claimed is:

1. An eco-mold apparatus for manufacturing a piston, the apparatus comprising:

a first eco-mold part configured to move forward and backward in a first direction in order to mold a portion of an eco-part of the piston;

a second eco-mold part configured to engage with the first eco-mold part in order to mold another portion of the eco-part of the piston; and a piston pickup part configured to pick up the piston over the second eco-mold part in order to separate the piston from the second eco-mold part, wherein the first eco-mold part comprises:

a first engaging surface having a first engaging angle relative to a central axis of the piston, at an engaging portion that is configured to engage with the second eco-mold part, such that the first eco-mold part engages with the second eco-mold part; and a box part molding surface disposed at a portion that corresponds to an outer side of a box part and having a second inclination angle relative to the central axis of the piston such that the outer side of the box part which is inclined is molded, and wherein the second eco-mold part comprises:

a second engaging surface having the first engaging angle at a portion that corresponds to the first engaging surface such that the second eco-mold part engages with the first eco-mold part, and wherein the first engaging angle is 6° to 10° larger than the second inclination angle of the box part molding surface relative to the central axis of the piston, and wherein the first direction is a direction inclined from the central axis of the piston by a third moving angle which is 3° to 5° larger than the second inclination angle relative to the central axis of the piston.

2. The apparatus according to claim 1, wherein the piston pickup part comprises:

a clamping member configured to press a portion of a side surface of a crown part of the piston and pick up the piston over the second eco-mold part.

3. The apparatus according to claim 1, wherein the piston pickup part is in a shape that corresponds to a picked-up portion of the piston, and wherein, after the first eco-mold part moves backward in the first direction, the piston pickup part picks up the piston over the second eco-mold part to separate the piston from the second eco-mold part.

4. The apparatus according to claim 1, wherein the first eco-mold part and the second eco-mold part are symmetrically formed on both sides relative to the central axis of the piston.

5. The apparatus according to claim 1, wherein the piston pickup part further comprises:

a vacuum suction member configured to pick up the piston over the second eco-mold part by vacuum suctioning an upper surface of the piston.

6. The apparatus according to claim 1, wherein the piston pickup part further comprises:

a magnetic member configured to pick up the piston over the second eco-mold part with magnetic force by contacting an upper surface of the piston.

7. A mold apparatus for manufacturing a piston, the apparatus comprising:

an upper mold configured to move up and down to form an upper portion of a crown part of the piston;

a left mold configured to slide to form one side of a side portion of the crown part of the piston;

a right mold configured to slide to form the other side of the side portion of the crown part of the piston;

a lower mold configured to move up and down to form an inner surface of a box part of the piston;

a pin mold configured to move left and right to form a pin hole of the piston; and the apparatus according to claim 1.

8. A mold apparatus for manufacturing a piston, the apparatus comprising:

an upper mold configured to move up and down to form an upper portion of a crown part of the piston;

a left mold configured to slide to form one side of a side portion of the crown part of the piston;

a right mold configured to slide to form the other side of the side portion of the crown part of the piston;

a lower mold configured to move up and down to form an inner surface of a box part of the piston;

a pin mold configured to move left and right to form a pin hole of the piston; and the apparatus according to claim 2.

9. A mold apparatus for manufacturing a piston, the apparatus comprising:

an upper mold configured to move up and down to form an upper portion of a crown part of the piston;

a left mold configured to slide to form one side of a side portion of the crown part of the piston;

a right mold configured to slide to form the other side of the side portion of the crown part of the piston;

a lower mold configured to move up and down to form an inner surface of a box part of the piston;

a pin mold configured to move left and right to form a pin hole of the piston; and the apparatus according to claim 3.

10. A mold apparatus for manufacturing a piston, the apparatus comprising:

an upper mold configured to move up and down to form an upper portion of a crown part of the piston;

a left mold configured to slide to form one side of a side portion of the crown part of the piston;

a right mold configured to slide to form the other side of the side portion of the crown part of the piston;

a lower mold configured to move up and down to form an inner surface of a box part of the piston;

a pin mold configured to move left and right to form a pin hole of the piston; and the apparatus according to claim 4.

11. A mold apparatus for manufacturing a piston, the apparatus comprising:

an upper mold configured to move up and down to form an upper portion of a crown part of the piston;

a left mold configured to slide to form one side of a side portion of the crown part of the piston;

a right mold configured to slide to form the other side of the side portion of the crown part of the piston;

a lower mold configured to move up and down to form an inner surface of a box part of the piston;

a pin mold configured to move left and right to form a pin hole of the piston; and the apparatus according to claim 5.

12. A mold apparatus for manufacturing a piston, the apparatus comprising:

an upper mold configured to move up and down to form an upper portion of a crown part of the piston;

a left mold configured to slide to form one side of a side portion of the crown part of the piston;

a right mold configured to slide to form the other side of the side portion of the crown part of the piston;

a lower mold configured to move up and down to form an inner surface of a box part of the piston;

a pin mold configured to move left and right to form a pin hole of the piston; and the apparatus according to claim 6.

* * * * *